US010697473B1

(12) United States Patent
Smith et al.

(10) Patent No.: US 10,697,473 B1
(45) Date of Patent: Jun. 30, 2020

(54) AERODYNAMIC MOTOR MOUNT ASSEMBLY FOR AN AIR IMPELLER

(71) Applicant: AIRSCAPE, INC., Medford, OR (US)

(72) Inventors: Neil B. Smith, Ashland, OR (US); Richard E. Jacobi, Grants Pass, OR (US)

(73) Assignee: AIRSCAPE, INC., Medford, OR (US)

( * ) Notice: Subject to any disclaimer, the term of this patent is extended or adjusted under 35 U.S.C. 154(b) by 190 days.

(21) Appl. No.: 15/016,555

(22) Filed: Feb. 5, 2016

Related U.S. Application Data

(60) Provisional application No. 62/180,928, filed on Jun. 17, 2015.

(51) Int. Cl.

| | |
|---|---|
| ***F04D 29/64*** | (2006.01) |
| ***F04D 19/00*** | (2006.01) |
| ***F04D 29/52*** | (2006.01) |
| ***F04D 29/40*** | (2006.01) |
| ***F04D 29/70*** | (2006.01) |

(52) U.S. Cl.
CPC ..... *F04D 29/644* (2013.01); *F04D 19/002* (2013.01); *F04D 29/403* (2013.01); *F04D 29/522* (2013.01); *F04D 29/703* (2013.01)

(58) Field of Classification Search
CPC .... F04D 29/644; F04D 29/646; F04D 25/068; F04D 25/0606; F04D 25/0613; F04D 13/0673; F04D 13/06; F04D 19/002; F04D 29/403; F04D 29/522; F04D 29/703; F24F 7/065
See application file for complete search history.

(56) References Cited

U.S. PATENT DOCUMENTS

| | | | | | |
|---|---|---|---|---|---|
| 2,451,970 | A | * | 10/1948 | Odor | F04D 29/646 248/603 |
| 2,615,620 | A | | 6/1950 | Goettl | |
| 2,621,849 | A | * | 12/1952 | Minnis | F04D 29/646 188/264 R |
| 2,781,165 | A | * | 2/1957 | Troller | F04D 29/646 29/432 |
| 3,322,331 | A | * | 5/1967 | Kenny | F04D 17/04 310/91 |
| 3,508,729 | A | | 4/1970 | Wilson | |
| 3,620,644 | A | | 11/1971 | McLarty | |

(Continued)

*Primary Examiner* — Kenneth J Hansen
*Assistant Examiner* — Julian B Getachew
(74) *Attorney, Agent, or Firm* — Jerry Haynes Law

(57) ABSTRACT

An aerodynamic motor mount assembly enhances air flow through an air impeller by providing support members that serve the dual purpose of concentrically mounting the air impeller into a housing, and stabilizing air flow being pulled through the air impeller. The air impeller comprises rotatable blades that are defined by a frontal plane, across which air is pulled through as the blades rotate. The impelled air flow engages a substantial portion of the support members before passing through the air impeller in a linear air flow continuum. The coplanar positioning of the support members relative to the blades, the aerodynamic surfaces and edges of the support members, and the radial disposition of the support members, work to direct the air across the frontal plane of the blades. The air flow engages the support members before passing through the air impeller in a linear air flow continuum, which reduces air turbulence.

20 Claims, 4 Drawing Sheets

(56) References Cited

U.S. PATENT DOCUMENTS

| | | | |
|---|---|---|---|
| 3,790,114 | A | 2/1974 | Italiano et al. |
| 5,660,367 | A | 8/1997 | Rush |
| 6,315,525 | B1 | 11/2001 | Webb |
| 6,478,838 | B2 | 11/2002 | McSweeney et al. |
| D526,713 | S | 8/2006 | Shelby et al. |
| 8,956,111 | B2 | 2/2015 | Eddisford |

* cited by examiner

AERODYNAMIC MOTOR MOUNT ASSEMBLY FOR AN AIR IMPELLER

CROSS REFERENCE OF RELATED APPLICATIONS

This application claims the benefits of U.S. provisional application No. 62/180,928, filed Jun. 17, 2015 and entitled AERODYNAMIC MOTOR MOUNT FOR FORMING A LINEAR AIR FLOW CONTINUUM THROUGH AN AIR IMPELLER, which provisional application is incorporated by reference herein in its entirety.

FIELD OF THE INVENTION

The present invention relates generally to an aerodynamic motor mount assembly that forms a linear air flow continuum through an air impeller. More so, the present invention relates to an aerodynamic motor mount assembly that provides a plurality of radially disposed support members having an aerodynamic surface and edges that orient air flow substantially perpendicular to a frontal plane of the blades of an air impeller to form a linear air flow continuum, such that air flow turbulence is reduced and air flow velocity is made more uniform across the entire surface of the frontal plane.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

A rotary mechanism, such as a fan or turbine, creates flow within a fluid, typically a gas such as air. The rotary mechanism consists of a rotating arrangement of vanes or blades which act on the fluid. The rotating assembly of blades and hub is known as an impeller, a rotor, or a runner. The rotary mechanism produces air flows with high volume and low pressure. Usually, the rotary mechanism is contained within some form of housing or case. This may direct the airflow or increase safety by preventing objects from contacting the fan blades. Most fans are powered by electric motors. Though, the blades and the motor must be mounted securely to minimize vibrations.

Typically, the conventional blades for the rotary mechanism function by accelerating or decelerating air, using blades mounted upon an axis and subsequently rotated. Due to the differences in rotational velocity of blade elements at the differing radial locations of such a blade, various locations therefore encounter flow from various directions.

In many instances, the rotating rotor blades are subject to cyclical variations in blade pitch angle, as well as unsteady high-subsonic airflow that can include relatively high frequency and relatively large amplitude variations in angle of attack and relatively rapid and periodic changes in an airflow velocity at one or more sections of each of the rotor blades. This can create undesirable air flow turbulence through the rotary mechanism, which is destabilizing.

Other proposals have involved rotary mechanisms that stabilize air flow and mechanical components. The problem with these rotary mechanisms is that they do not enable formation of a linear air flow continuum, while also mounting the motor concentrically in the housing for stability.

Even though the above cited rotary mechanisms meet some of the needs of the market, an aerodynamic motor mount assembly that provides a plurality of radially disposed support members having an aerodynamic surface and edges that orient air flow substantially perpendicular to a frontal plane of the blades of an air impeller to form a linear air flow continuum, such that air flow turbulence is reduced and air flow velocity is made more uniform across the entire surface of the frontal plane is still desired.

SUMMARY

Illustrative embodiments of the disclosure are generally directed to an aerodynamic motor mount assembly for enhancing air flow through an air impeller. The aerodynamic motor mount assembly enhances air flow through an air impeller by providing a plurality of support members that serve the dual purpose of securely mounting the air impeller, and stabilizing air flow being pulled through the air impeller. The air impeller comprises a plurality of blades that are defined by a frontal plane, across which air is pulled through as the blades rotate. The support members mount the blades with in a housing in a generally concentric disposition. The air flow engages a substantial portion of the support members before passing through the blades in a linear air flow continuum.

The coplanar positioning of the support members relative to the blades, the aerodynamic surfaces and edges of the support members, and the radial disposition of the support members work to direct the air across the frontal plane of the blades in a linear air flow continuum. The linear air flow continuum helps reduce air flow turbulence and helps maintain uniform air flow velocity across the air impeller. The reduced air flow turbulence and uniform air flow velocity creates optimal air flow conditions through the air impeller.

In one aspect, the aerodynamic motor mount assembly for forming a linear air flow continuum through an air impeller, comprises:

- an air impeller, the air impeller comprising:
  - a housing, the housing defined by an inner surface, an outer surface, an air inflow end, and an air outflow end;
  - a motor, the motor disposed generally concentric in the housing;
  - a hub, the hub configured to operatively connect to the motor;
  - a plurality of blades, the plurality of blades defined by a frontal plane, the plurality of blades configured to operatively connect to the hub, the plurality of blades further configured to impel air from the air inflow end to the air outflow end of the housing; and
- a plurality of support members, the plurality of support members disposed generally adjacent and coplanar to the frontal plane of the plurality of blades, the plurality of support members further disposed proximal to the air inflow end of the housing, the plurality of support members configured in a generally radial disposition,
- the plurality of support members defined by a housing end, a motor end, an inflow edge, and an outflow edge, the housing end configured to join with the inner surface of the housing, the motor end configured to support the motor generally concentrically in the housing, the inflow edge having a generally curved, tapered configuration, the outflow edge having a generally tapered configuration, wherein the inflow edge and the outflow edge of the plurality of support members direct the air flow in a substantially perpendicular orientation relative to the frontal plane, wherein the substantially perpendicular orientation of the air flow relative to the frontal plane forms a linear air flow continuum across the plurality of blades.

One objective of the present invention is to provide an aerodynamic mount that directs air flow generally perpendicular in relation to a frontal plane of the air impeller.

Another objective is to create a linear air flow continuum across the blades of an air impeller.

Another objective is to provide a plurality of support members that have aerodynamic edges and surfaces.

Yet another objective is to create uniform air flow velocity through the air impeller.

Yet another objective is to reduce air flow turbulence through the air impeller.

Yet another objective is to minimize vibrations in the air impeller during operation.

Yet another objective is to provide structural support for the motor, such that the motor is concentrically disposed in the housing.

Yet another objective is to securely fasten the housing end of the support members to the inner surface of the housing with a bracket.

Yet another objective is to provide support assemblies that can be interchanged between different air impellers.

Yet another objective is to provide support members that are inexpensive to manufacture, and that can be attached to a wide variety of air impellers.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
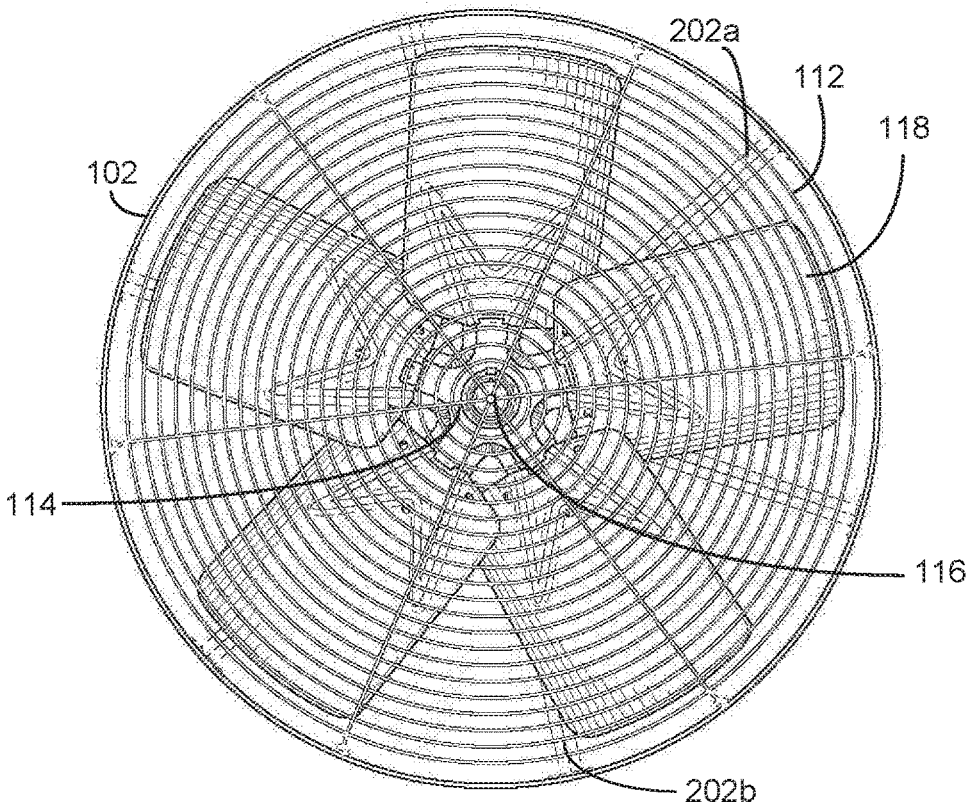
FIG. 1 illustrates a front view of an air outflow end of an air impeller, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An aerodynamic motor mount 200 for enhancing air flow through an air impeller assembly 100 is referenced in FIGS. 1-5. The aerodynamic motor mount assembly 200, hereafter, "assembly 200" enhances air flow through an air impeller 100 by providing a plurality of support members 202*a*, 202*b*, 202*c* that serve the dual purpose of securely mounting the air impeller 100 into a housing 102 while also stabilizing air flow being pulled through the air impeller 100. The support members 202*a-c* are disposed generally coplanar and adjacent to the air impeller 100. The air flow engages a substantial portion of the support members 202*a-c* before passing through the air impeller 100 as a linear air flow continuum. The support members 202*a-c* affect the air flow due to their generally radial disposition in the housing 102, their coplanar disposition relative to the air impeller 100, and their unique configuration of aerodynamic surfaces and edges.

The air impeller 100 comprises a plurality of blades 118 that rotate to generate air flow. The blades 118 are defined by a frontal plane, across which the impelled air flow is pulled through as the blades 118 rotate. The support members 202*a-c* are disposed generally coplanar and adjacent to the blades 118. The support members 202*a-c* have tapered edges and surfaces that create an aerodynamic effect. The support members 202*a-c* are also radially disposed.

Thus, a linear air flow continuum is formed due chiefly to: 1) The coplanar positioning of the support members 202*a-c* relative to the blades 118; 2) the aerodynamic surfaces and edges of the support members 202*a-c*; and 3) the radial disposition of the support members 202*a-c*. These factors work to direct air perpendicularly across the frontal plane of the blades 118. This perpendicular disposition between the air flow and the frontal plane of the blades 118 forms a linear air flow continuum. The linear air flow continuum helps reduce air flow turbulence and helps maintain uniform air flow velocity across the air impeller 100. The reduced air flow turbulence and uniform air flow velocity creates optimal air flow conditions through the air impeller 100.

In some embodiments, the air impeller 100 may comprise a housing 102, a motor 114, a hub 116, and a plurality of blades 118. The support members 202*a-c* comprise a housing end 208, and a motor end 210. The housing end 208 joins with the inner surface 108 of the housing 102. The motor end 210 joins with the motor 114, forming a structural support for the motor 114 and the blades 118, generally concentrically in the housing. The support members 202*a-c* extend radially from the housing 102 to the motor 114, while holding the motor 114 concentrically in the housing 102. The support members 202*a-c* are also defined by an inflow edge 204 and an outflow edge 206 that are curved and tapered to efficiently direct the air flow in a perpendicular orientation relative to the frontal plane.

As referenced in FIG. 1, the aerodynamic mount 200 is operable with an air impeller 100 that generates air flow through rotation of the blades 118. The air impeller 100 may include, without limitation, a fan, an axial-flow fan, a centrifugal fan, a cross-flow fan, a bellow, an air duct, a turbine, and a jet engine. The air impeller 100 has an air inflow end 104 and an air outflow end 106, through which air flow is impelled (FIG. 2).

Figure 2:
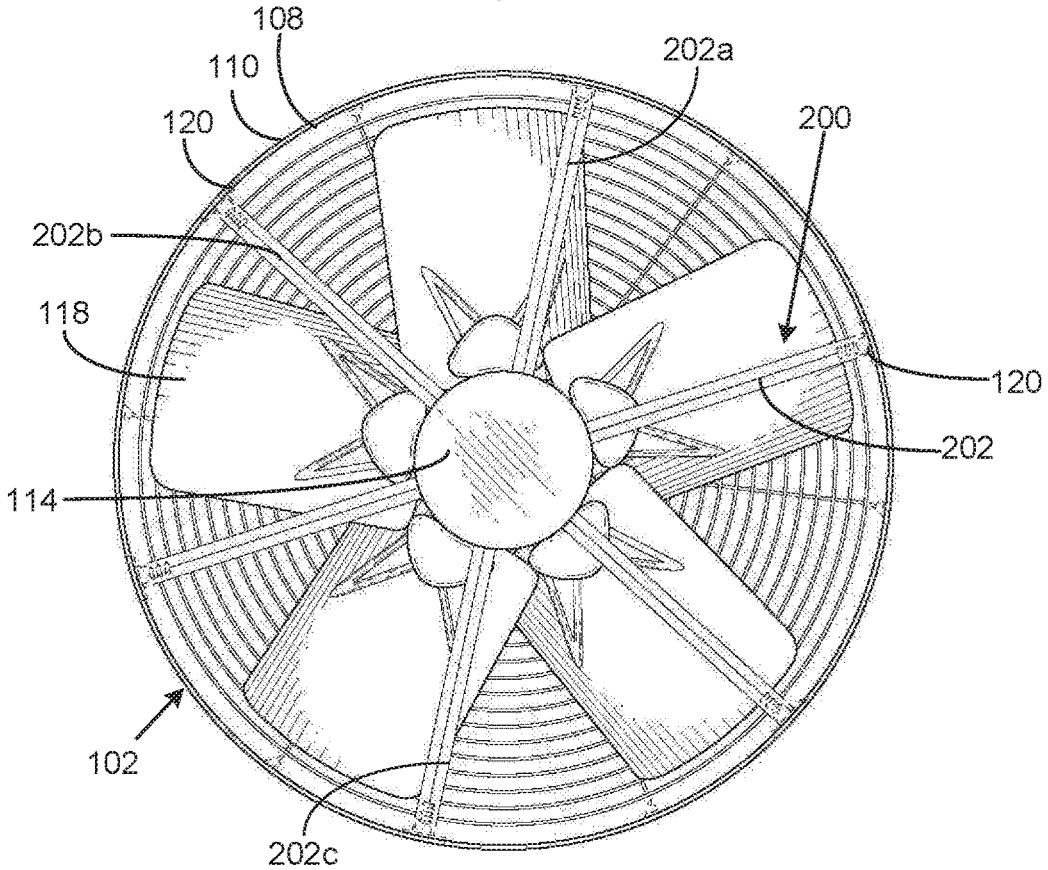
FIG. 2 illustrates a rear view of an air inflow end of an air impeller, in accordance with an embodiment of the present invention.

Looking again at FIG. 2, the aerodynamic mount 200 positions proximal to the air inflow end 104. The aerodynamic surface of the aerodynamic mount 200 directs the air flow in a perpendicular orientation relative to the frontal plane. The frontal plane may include an imaginary plane that frontals a cross section of the air impeller 100. This forms a linear air flow continuum through the air impeller 100, which helps reduce air flow turbulence and helps create a uniform air flow velocity across the entire surface of the frontal plane, and subsequently, the blades 118.

Figure 3:
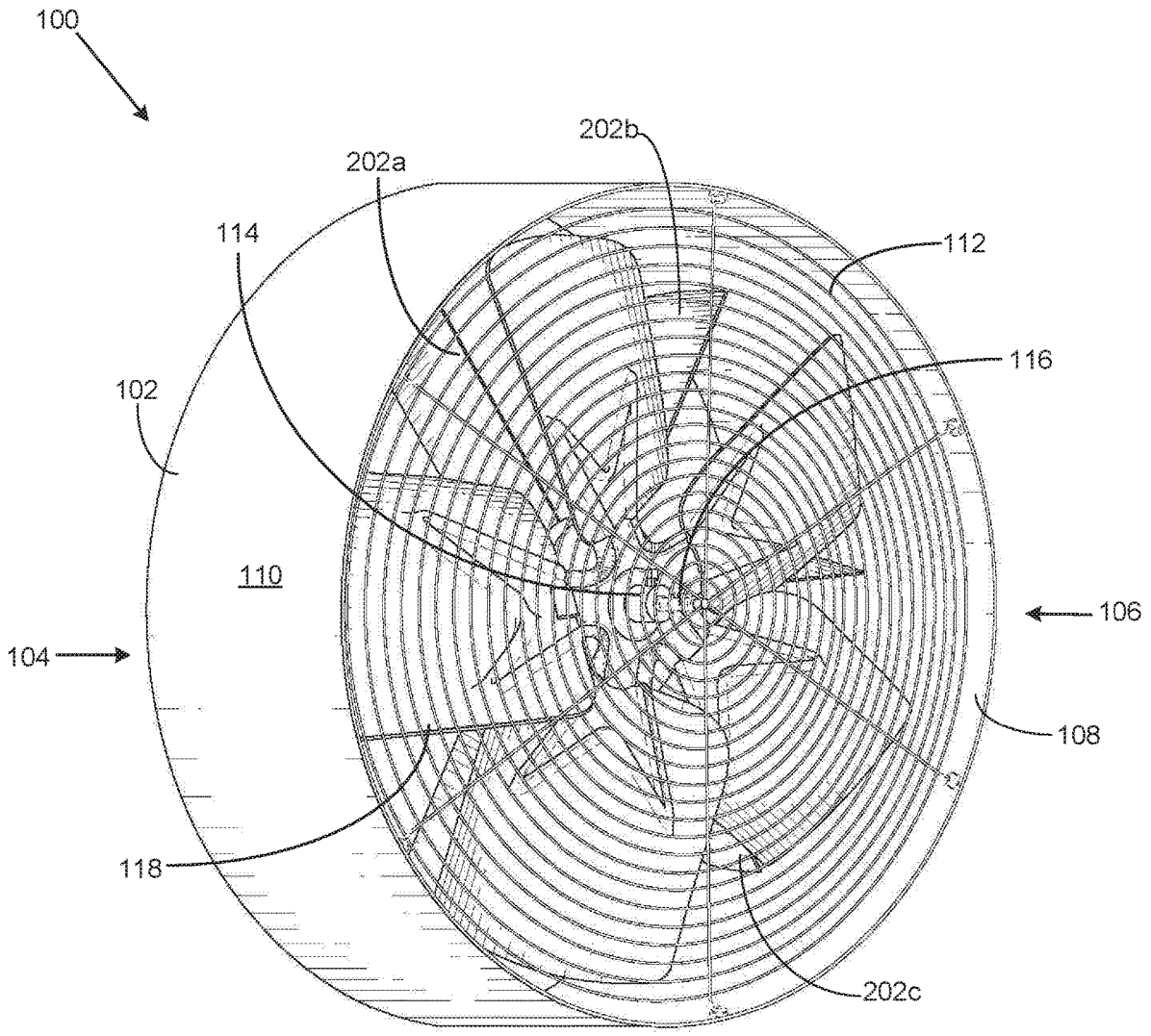
FIG. 3 illustrates a perspective view of an exemplary air outflow end of an air impeller, in accordance with an embodiment of the present invention.
Figure 4:
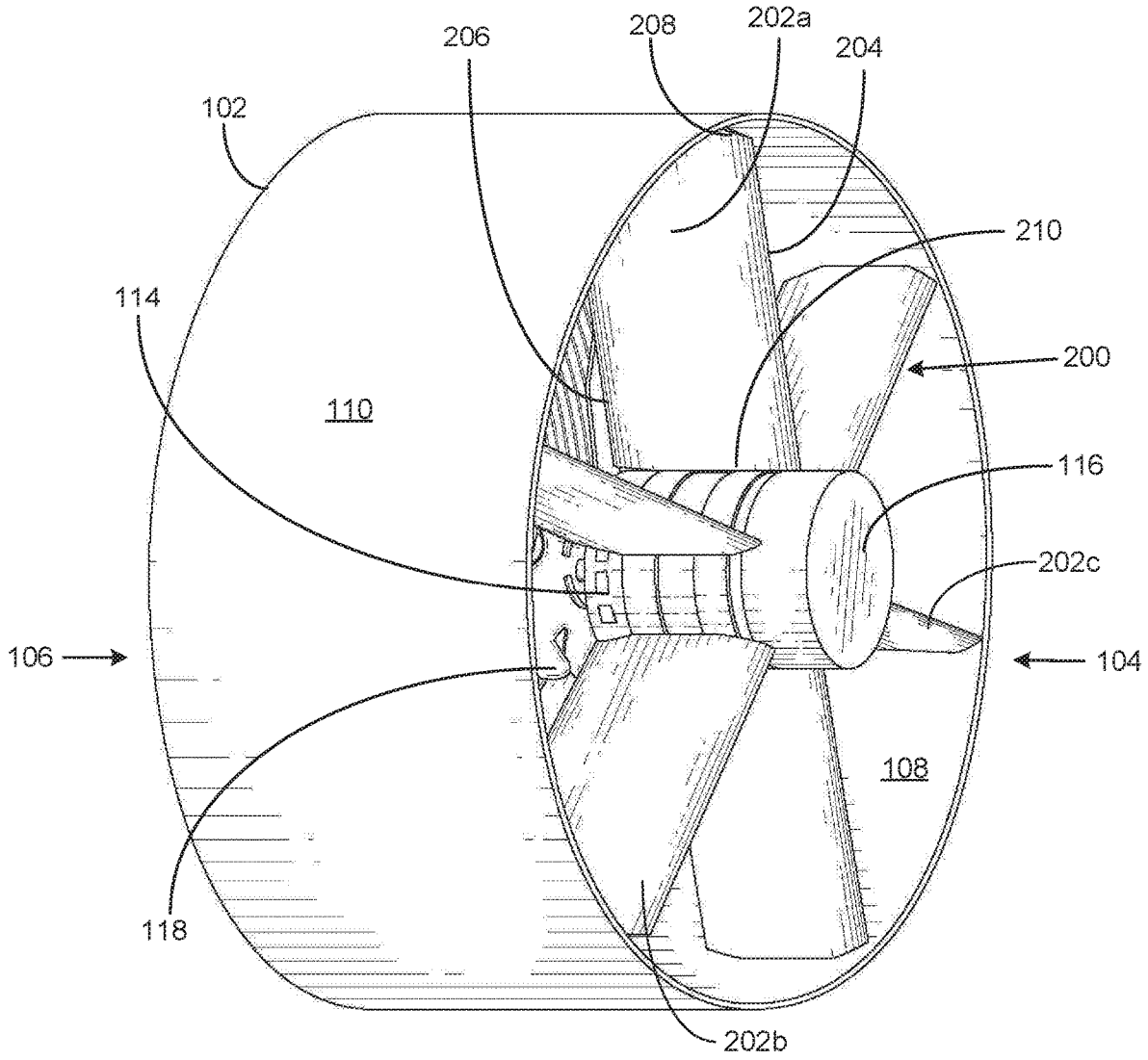
FIG. 4 illustrates a perspective view of an exemplary aerodynamic mount from air inflow end of an air impeller, in accordance with an embodiment of the present invention.

Turning now to FIG. 3, the aerodynamic mount 200 is configured to provide structural support to components of the air impeller 100, and also to create an aerodynamic effect on the air flow entering the air inflow end 104 of the air impeller 100. The air impeller 100 may include a housing 102. The housing 102 is configured to form a conduit for the air flow. The housing 102 is also efficacious for protecting the various components of the air impeller 100 and the aerodynamic mount 200. As illustrated in FIG. 4, the housing 102 is defined by an air inflow end 104, an air outflow end 106, an inner surface 108, and an outer surface 110. The air impeller 100 forces air from the air inflow end 104 towards the air outflow end 106 of the housing 102. In one embodiment, the air outflow end 106 of the housing has a grating 112 to inhibit entry of objects through the air outflow end 106.

Turning back to FIG. 1, a motor 114 is concentrically disposed in the housing 102. The motor 114 provides power for actuating the air impeller 100. A hub 116 operatively attaches to the motor 114. The power that is generated by the motor 114 rotates the hub 116. A plurality of blades 118 extend radially from the hub 116. The blades 118 rotate in a first direction to impel the air flow from the air inflow end 104 towards the air outflow end 106 of the housing 102. The blades 118 may have a pitch, so as to increase the air flow velocity or directionally guide the air flow through the housing 102.

In some embodiments, the frontal plane is an imaginary plane that is coplanar with the blades 118. The aerodynamic mount 200 enables the airflow to be directed perpendicular relative to the frontal plane. This, in essence forms a linear continuum of air flow through the housing 102. Incidentally, the linear continuum air flow runs parallel to the inner surface 108 of the housing 102.

As shown in FIG. 4, the aerodynamic mount 200 is configured to secure the motor 114 concentrically in the housing 102, while simultaneously creating an aerodynamic effect on the air flow. The aerodynamic mount 200 is defined by a plurality of support members 202*a-c* that extend radially from the motor 114 to the inner surface 108 of the housing 102. The support members 202*a-c* are defined by a housing end 208, and a motor end 210. A bracket 120 fastens the housing end 208 of each support member 202*a-c* to the inner surface 108 of the housing 102. The motor end 210 of each support member 202*a-c* may fasten to the motor 114 through any number of fastening mechanisms, including, without limitation, welding, bolts, magnets, adhesives, and frictional fitting. Both ends of the support members 202*a-c* fasten to a fixed surface however. In some embodiments, the support members 202*a-c* may detach from the air impeller 100 and reattach to any number of air impellers.

In one embodiment, the support members 202*a-c* are evenly-spaced, extending radially from the motor 114. The support members 202*a-c* form a generally elongated plane. The support members 202*a-c* are sufficiently rigid, so as to mount the motor 114 concentrically in the housing 102. Suitable materials for the support members 202*a-c* may include, without limitation, light gauge aluminum, steel, iron, metal alloys, fiberglass, wood, and polymers.

Figure 5:
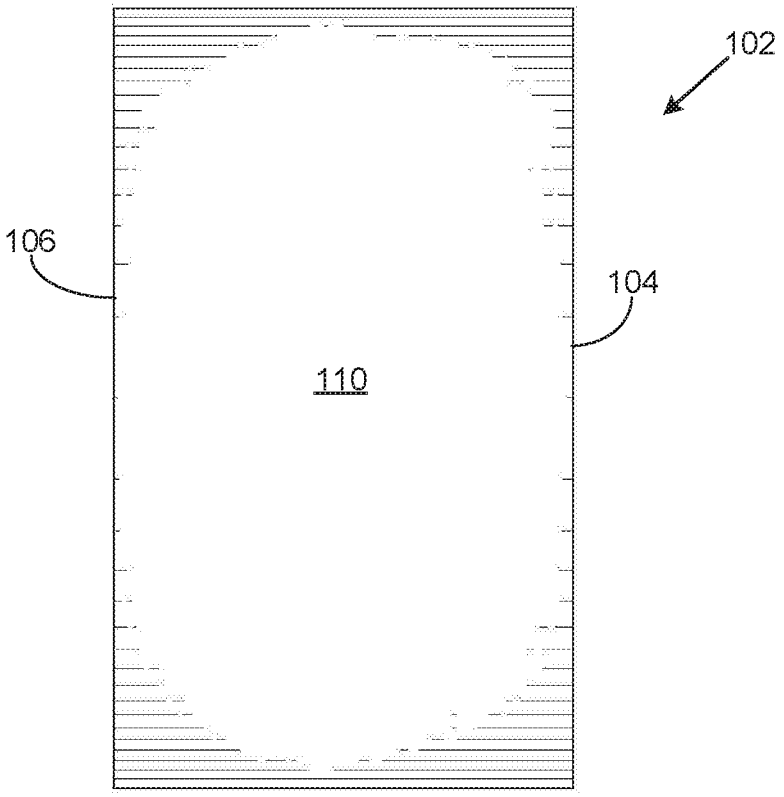
FIG. 5 illustrates an elevated side view of a housing for the air impeller, in accordance with an embodiment of the present invention.

As referenced in FIG. 5, the support members 202*a-c* are further defined by an inflow edge 204 that is proximal to the air inflow end 104 of the housing 102, and an outflow edge 206 that is proximal to the air outflow end 106 of the housing 102. The inflow edge 204 is the surface on the support member 202*a-c* that the air flow initially engages. The inflow edge 204 is generally curved and tapered so as to minimize friction and turbulence with the sir flow. After passing around the inflow edge 204, the air flow crosses the surface of the support members 202*a-c*. At this point, the air flow has formed a generally linear air flow continuum. The air flow then flows past the outflow edge 206, towards the blades 118. The unique aerodynamic edges of the support members 202*a-c*, therefore, enable the airflow to have a reduced air flow turbulence and uniform air flow velocity.

Those skilled in the art will recognize that the velocity of air flow is greater towards the center region of the housing 102 than the outer region of the housing 102. This is because the air flow encounters friction at the inner surface 108 (outer region) of the housing 102. The support members 202*a-c* help equalize the airflow velocity between the outer and center regions by traversing the housing 102 from the inner surface 108 to the motor 114 in the center region. This creates greater friction at the center region, which enables a more uniform air flow velocity across the frontal plane.

Additionally, those skilled in the art will recognize that turbulent air flow is characterized by chaotic property changes. This includes low momentum diffusion, high momentum convection, and rapid variation of pressure and flow velocity in space and time. The aerodynamic edges 204, 206 of the support members 202*a-c* are generally evenly-spaced and uniform in thickness, which helps alleviate turbulence. These physical parameters of the support members 202*a-c* stabilizes the air flow, which consequently helps reduce turbulence in the housing 102. This also serves to minimize vibrations in the air impeller 100 during operation. Thus, the reduction in turbulence and uniformity of air velocity create a linear air flow continuum for optimal air flow conditions through the air impeller 100.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An aerodynamic motor mount assembly for forming a linear air flow continuum through an air impeller, comprising:

the air impeller comprising:

a housing, the housing defined by an inner surface, an outer surface, an air inflow end, and an air outflow end;

a plurality of blades, the plurality of blades defined by a frontal plane, the plurality of blades configured to impel air flow from the air inflow end to the air outflow end of the housing; and a plurality of support members each having opposite first and second planar surfaces, the plurality of support members disposed adjacent to the frontal plane of the plurality of blades in a plane parallel to the frontal plane of the plurality of blades, the plurality of support members further disposed adjacent to the air inflow end of the housing, the plurality of support members configured in a radial disposition, each of the plurality of support members defined by a housing end, a motor end, a curved and tapered inflow edge, a curved and tapered outflow edge and a planar center portion having opposite first and second center portion surfaces and extending between the inflow edge and the outflow edge, the inflow edge and the outflow edge of each of the plurality of support members evenly-spaced around the housing, the housing end of the plurality of support members configured to join with the inner surface of the housing, the motor end configured to join with the plurality of blades for supporting the plurality of blades concentrically in the housing, the inflow edge having a curved, tapered configuration, the outflow edge having a tapered configuration, the inflow edge and the outflow edge angled from the planar center portion and extending beyond the first center portion surface, each of the plurality of support members forming an elongated plane from the housing end to the motor end, whereby the inflow edge and the outflow edge of the plurality of support members direct the air in a perpendicular orientation relative to the frontal plane, whereby the perpendicular orientation of the air flow relative to the frontal plane forms a linear air flow continuum across the plurality of blades.

2. The assembly of claim 1, wherein the air impeller includes a fan.

3. The assembly of claim 1, wherein the plurality of blades rotatably impel the air flow.

4. The assembly of claim 1, wherein the air impeller comprises a motor, the motor disposed concentric in the housing.

5. The assembly of claim 4, wherein the air impeller comprises a hub, the hub configured to operatively connect to the motor.

6. The assembly of claim 5, wherein the plurality of blades are configured to operatively connect to the hub.

7. The assembly of claim 6, wherein the air outflow end of the housing has a grating.

8. The assembly of claim 7, wherein the motor is configured to power the plurality of blades.

9. The assembly of claim 1, further including a bracket, the bracket configured to mount the housing end of the plurality of support members to the inner surface of the housing.

10. The assembly of claim 1, wherein the plurality of support members are elongated and flat.

11. The assembly of claim 1, wherein the plurality of support members are fabricated from aluminum.

12. An aerodynamic motor mount assembly for forming a linear air flow continuum through an air impeller, comprising:

the air impeller comprising:

a housing, the housing defined by an inner surface, an outer surface, an air inflow end, and an air outflow end, the housing having a uniform diameter from the air inflow end to the air outflow end;

a motor, the motor disposed concentric in the housing;

a hub, the hub configured to operatively connect to the motor;

a plurality of blades, the plurality of blades defined by a frontal plane, the plurality of blades configured to operatively connect to the hub, the plurality of blades further configured to impel air from the air inflow end to the air outflow end of the housing; and a plurality of support members each having opposite first and second planar surfaces, the plurality of support members disposed adjacent to the frontal plane of the plurality of blades in a plane parallel to the frontal plane of the plurality of blades, the plurality of support members further disposed adjacent to the air inflow end of the housing, the plurality of support members configured in a radial disposition, each of the plurality of support members defined by a housing end, a motor end, a curved and tapered inflow edge, a curved and tapered outflow edge, and a planar center portion having opposite first and second center portion surfaces and extending between the inflow edge and the outflow edge, the inflow edge and the outflow edge of each of the plurality of support members evenly-spaced around the housing, the housing end of the plurality of support members configured to join with the inner surface of the housing, the motor end configured to support the motor concentrically in the housing, the inflow edge having a curved, tapered configuration, the outflow edge having a tapered configuration, the inflow edge and the outflow edge angled from the planar center portion and extending beyond the first center portion surface, each of the plurality of support members forming a generally elongated plane from the housing end to the motor end, whereby the inflow edge and the outflow edge of the plurality of support members direct the air flow in a perpendicular orientation relative to the frontal plane, whereby the perpendicular orientation of the air flow relative to the frontal plane forms a linear air flow continuum across the plurality of blades.

13. The assembly of claim 12, wherein the air impeller includes a fan.

14. The assembly of claim 12, wherein the plurality of blades rotatably impel the air flow.

15. The assembly of claim 12, wherein the air outflow end of the housing has a grating.

16. The assembly of claim 12, wherein the motor is configured to power the plurality of blades.

17. The assembly of claim 12, wherein the plurality of support members are elongated and flat.

18. The assembly of claim 12, further including a bracket, the bracket configured to mount the housing end of the plurality of support members to the inner surface of the housing.

19. The assembly of claim 12, wherein the plurality of support members are fabricated from aluminum.

20. An aerodynamic motor mount assembly for forming a linear air flow continuum through an air impeller, comprising:

the air impeller comprising:

a housing, the housing defined by an inner surface, an outer surface, an air inflow end, and an air outflow end, the air outflow end of the housing comprising a grating and the housing having a uniform diameter from the air inflow end to the air outflow end;

a motor, the motor disposed concentric in the housing;

a hub, the hub configured to operatively connect to the motor;

a plurality of blades, the plurality of blades defined by a frontal plane, the plurality of blades configured to operatively connect to the hub, the plurality of blades further configured to impel air from the air inflow end to the air outflow end of the housing;

a plurality of support members each having opposite first and second planar surfaces, the plurality of support members disposed adjacent to the frontal plane of the plurality of blades in a plane parallel to the frontal plane of the plurality of blades, the plurality of support members further disposed adjacent to the air inflow end of the housing, the plurality of support members configured in a radial disposition, each of the plurality of support members defined by a housing end, a motor end, a curved and tapered inflow edge, a curved and tapered outflow edge, and a planar center portion having opposite first and second center portion surfaces extending between the inflow edge and the outflow edge, the inflow edge and the outflow edge of each of the plurality of support members evenly-spaced around the housing the housing end of the plurality of support members configured to join with the inner surface of the housing, the motor end configured to support the motor concentrically in the housing, the inflow edge having a curved, tapered configuration, the outflow edge having a tapered configuration, the inflow edge and the outflow edge angled from the planar center portion and extending beyond the first center portion surface, each of the plurality of support members forming an elongated plane from the housing end to the motor end, wherein the plurality of support members are configured in an elongated and flat shape, whereby the inflow edge and the outflow edge of the plurality of support members direct the air flow in a perpendicular orientation relative to the frontal plane, whereby the perpendicular orientation of the air flow relative to the frontal plane forms a linear air flow continuum across the plurality of blades; and a bracket, the bracket configured to mount the housing end of the plurality of support members to the inner surface of the housing.

* * * * *